US012286288B2

(12) United States Patent
Hodges

(10) Patent No.: US 12,286,288 B2
(45) Date of Patent: Apr. 29, 2025

(54) COLLATION OF PACKAGES FOR DELIVERY SYSTEMS

(71) Applicant: British American Tobacco (Investments) Limited, London (GB)

(72) Inventor: Paul Hodges, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 17/775,646

(22) PCT Filed: Nov. 11, 2020

(86) PCT No.: PCT/GB2020/052858
§ 371 (c)(1),
(2) Date: May 10, 2022

(87) PCT Pub. No.: WO2021/094738
PCT Pub. Date: May 20, 2021

(65) Prior Publication Data

US 2022/0396416 A1 Dec. 15, 2022

(30) Foreign Application Priority Data

Nov. 11, 2019 (GB) ..... 1916393

(51) Int. Cl.
*B65D 85/10* (2006.01)
*B65D 63/10* (2006.01)

(52) U.S. Cl.
CPC ..... *B65D 85/1072* (2013.01); *B65D 63/1009* (2013.01); *B65D 2563/101* (2013.01)

(58) Field of Classification Search
CPC ..... B65D 85/1072; B65D 63/1009
(Continued)

(56) References Cited

U.S. PATENT DOCUMENTS 1,864,493 A * 6/1932 La Bombard ..... A21D 15/00 206/460
2,578,583 A * 12/1951 O'Brien ..... B65D 71/0085 206/460

(Continued)

FOREIGN PATENT DOCUMENTS

| | | | |
|---|---|---|---|
| EP | 0344466 | A2 | 12/1989 |
| JP | S57156458 | U | 10/1982 |
| WO | 9964531 | A1 | 12/1999 |

OTHER PUBLICATIONS

Russian Office Action for corresponding application 2022112361; Report dated Nov. 17, 2022.

(Continued)

*Primary Examiner* — Jacob K Ackun
(74) *Attorney, Agent, or Firm* — CANTOR COLBURN LLP

(57) ABSTRACT

The present invention relates to a collation of packages. The collation of packages comprises a plurality of individual packages, each package comprising a pair of opposing first faces, a pair of opposing second faces, and a pair of opposing end faces. The packages are arranges in rows in which each package is aligned in a face-to face orientation such that a first face of a package faces a first face of an adjacent package within a row, and a second face of a package in a row faces a second face of a package in an adjacent row, and a first face of a package at the end of each row is exposed. The tap is adhered to the packages across their end faces and is positioned so as to couple packages in adjacent rows together, and packages within the same row together. The tape is also adhered to said exposed first faces of the packages at the end of each row so as to extend across the exposed first faces of adjacent packages.

11 Claims, 3 Drawing Sheets

(58) Field of Classification Search
USPC ..... 206/460
See application file for complete search history.

(56) References Cited

U.S. PATENT DOCUMENTS 2,605,897 A * 8/1952 Rundle ..... B65D 75/5844 206/264
2,895,601 A * 7/1959 Krukonis ..... B65D 85/1072 229/87.06
3,071,244 A * 1/1963 Doran ..... B65D 5/5495 206/45.29
3,086,650 A * 4/1963 James ..... B65D 75/52 229/87.13
3,113,673 A * 12/1963 Stein ..... B65D 5/4275 206/820
3,721,335 A * 3/1973 Grant ..... B65D 85/1072 206/256
3,752,308 A * 8/1973 Begemann ..... B65D 77/02 206/256
3,987,901 A * 10/1976 Dullinger ..... B65C 9/10 206/451
4,631,900 A * 12/1986 Mattei ..... B65D 5/4275 53/448
4,738,359 A * 4/1988 Phillips, Jr. ..... B65D 85/1072 206/256
4,928,817 A * 5/1990 Focke ..... B65D 85/1072 206/256
5,141,106 A * 8/1992 Adams ..... B65D 5/5495 206/256
5,178,268 A * 1/1993 Talley ..... B65D 5/5495 53/448
5,201,413 A * 4/1993 DeBlasio ..... B65D 5/5495 53/448
5,657,870 A * 8/1997 Schottle ..... B65D 71/0085 235/487
8,910,782 B2 * 12/2014 Koster ..... B65B 11/08 206/256
2005/0172977 A1 8/2005 Jadot

OTHER PUBLICATIONS

International Search Report for corresponding application PCT/GB2020/052858 filed Nov. 11, 2020; Mail date Feb. 12, 2021.
Written Opinion of the International Searching Authority for corresponding application PCT/GB2020/052858 filed Nov. 11, 2020; Mail date Feb. 12, 2021.
European Search Report for corresponding application 20 812 402.4; Report dated Feb. 22, 2024.

* cited by examiner

COLLATION OF PACKAGES FOR DELIVERY SYSTEMS

TECHNICAL FIELD

The present invention relates to a collation of packages for delivery systems.

BACKGROUND

Known delivery systems are usually sold in cartons comprising a plurality of packages of delivery systems. The cartons may be formed from cardboard or a similar material. Alternatively, the plurality of packages may be wrapped in plastic. However, the cartons and/or wraps must be opened and then discarded to access the individual packages of delivery systems.

SUMMARY

According to embodiments of the present invention, there is provided a collation of packages, the collation comprising a plurality of individual packages, wach package comprising a pair of opposing first faces, a pair of opposing second faces, and a pair of opposing end faces, wherein the packages are arranges in rows in which each package is aligned in a face-to-face orientation such that a first face of a package faces a first face of an adjacent package within a row, and a second face of a package in a row faces a second face of a package in an adjacent row, and a first face of a package at the end of each row is exposed, and wherein tape is adhered to the packages across their end faces and is positioned so as to couple packages in adjacent rows together, and packages within the same row together, wherein tape is also adhered to said exposed first faces of the packages at the end of each row so as to extend across the exposed first faces of adjacent packages.

In some embodiments, the tape may be formed by a single continuous tape.

The continuous tape may extend completely around a dividing line formed between the second faces of packages in a first row and the adjacent second faces of packages in a second row.

In some embodiments, the tape may comprise a plurality of discrete portions of tape.

Preferably, a longitudinal axis of a discrete portion of tape extends parallel to a dividing line between the second faces of packages in a first roe and the second faces of packages in a second row.

Adjacent packages in a row may be separated by a separation line formed between adjacent first faces in a row, wherein at least one adhesive tape located on adjacent side faces of the first and second rows of packages overlaps the separation line.

The separation line may extend perpendicularly to the dividing line between adjacent rows.

The tape may comprise a line of weakening configured to allow an individual package to be separated from its adjacent packages without the remaining packages of the collation being separated.

In some embodiments, the line of weakening may be a continuous line of weakening.

The line of weakening may be a longitudinal line of weakening which extends parallel to the dividing line between adjacent rows of packages.

Preferably, the longitudinal line of weakening extends coincidentally with the dividing line between adjacent rows of packages.

In some embodiments, the tape may comprise a line of weakening which is a transverse line of weakening which extends parallel to the separation line between adjacent packages in a row.

Preferably, the transverse line of weakening extends coincidentally with the separation line between individual packages in a row.

In some embodiments, the tape may comprise a registration mark configured to aid in placing the line of weakening of the tape coincidentally with the dividing line and/or separation line.

Preferably, the registration mark comprises a marking which is coincident with the line of weakening.

The packages of the collation of packages may be packages for delivery systems.

BRIEF DESCRIPTION OF THE DRAWINGS

So that the invention may be more fully understood, embodiments of the present invention will now be described, by way of example only, with reference to the accompanying drawings, in which.

DETAILED DESCRIPTION

As used herein the term "delivery system" is intended to encompass systems that deliver a substance to a user, and includes:

- combustible aerosol provision systems, such as cigarettes, cigarillos, cigars, and tobacco pipes or for roll-your-own cigarettes (whether based on tobacco, tobacco derivatives, expanded tobacco, reconstituted tobacco, tobacco substitutes or other smokeable material);
- non-combustible aerosol provision systems that release compounds from an aerosolisable material without combusting the aerosolisable material, such as electronic cigarettes, tobacco heating products, and hybrid systems to generate aerosol using a combination of aerosolisable materials;
- articles comprising aerosolisable material and configured to be used within one of these non-combustible aerosol provision systems; and
- aerosol-free delivery systems, such as lozenges, gums, patches, articles comprising inhalable powders, and smokeless tobacco products such as snus and snuff, which deliver a material to a user without forming an aerosol, wherein the material may or may not comprise nicotine.

According to the present disclosure, a "combustible" aerosol provision system is one where a constituent aerosoliable material of the aerosol provision system (or component thereof) is combusted or burned in order to facilitate delivery to a user.

According to the present disclose, a "non-combustible" aerosol provision system is one where a constituent aerosolisable material of the aerosol provision system (or component thereof) is not combusted or burned in order to facilitate delivery to a user.

Figure 1:
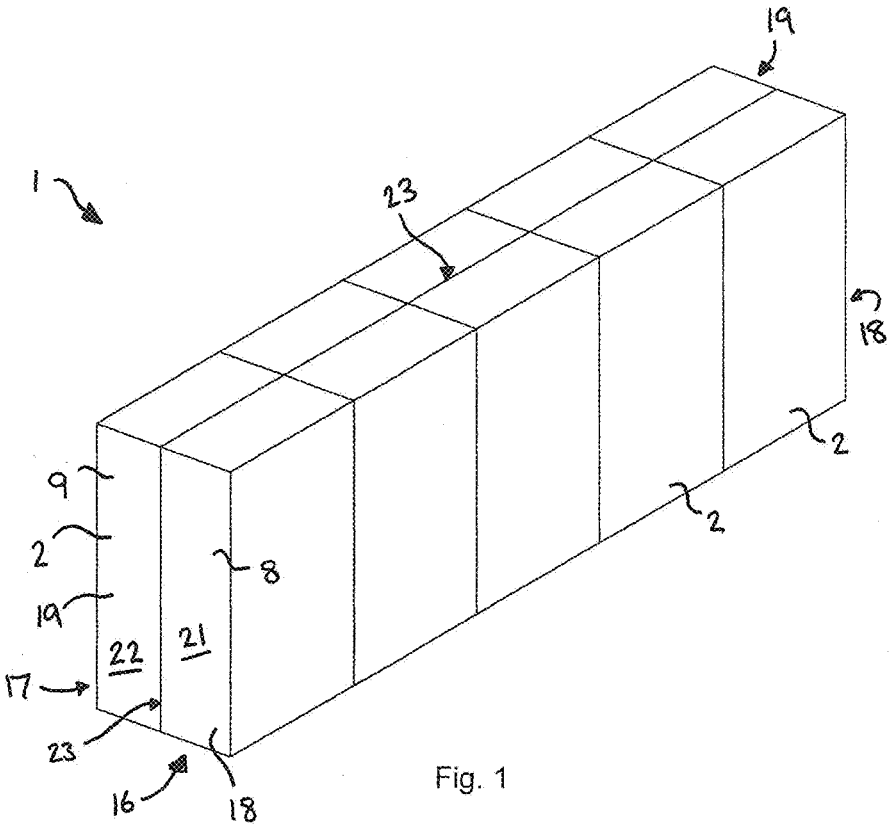
FIG. 1 shows a collation of packages for delivery systems without the adhesive strip attached to the packages.

Referring to FIG. 1, there is shown a collation 1 of packages 2 for delivery systems (not shown). The collation 1 of packages 2 comprises a plurality of individual packages 2. An exemplary individual package 2 for delivery systems is shown in FIG. 2.

Figure 2:
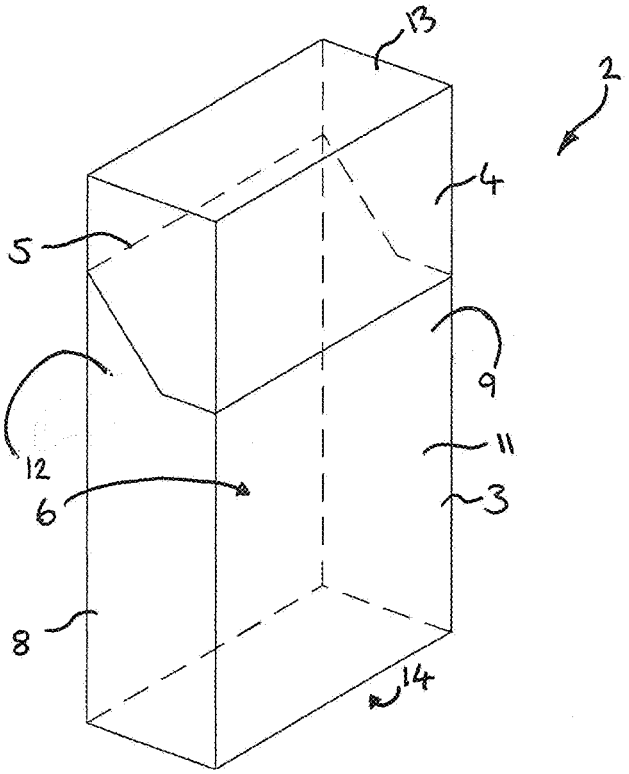
FIG. 2 shows an individual package of a collation of packages.

Referring briefly to FIG. 2, the package 2 may be, for example, but not limited to, a hinge lid pack, as illustrated. The package 2 comprises a container 3 and a lid 4 hingedly connected to the container 3 along a hinge line 5 in order to allow the package to be opened and closed. It will be appreciated that the container 3 forms a delivery system receiving space 6 in which delivery systems such as smoking articles are receivable. The delivery systems are accessible when the lid 4 is in an open position, and the delivery systems are retained in the delivery system receiving space 6 when the lid 4 is in a closed position. It will be understood, that in an alternative embodiment, the package 2 may be a (clam and shell pack, etc).

The package 2 comprises a pair of opposing first faces 11, 12, a pair of opposing second faces 8, 9, and a pair of opposing end faces 13, 14. The pair of opposing first faces 11, 12 are separated by opposing second faces 8, 9. In the present embodiment, the opposing second faces 8, 9 form major panels 8, 9 which make up the front and rear panels of the package 2. The front second face or major panel 8 may comprise a front container wall and a front lid wall. The rear second face or major panel 9 may comprise a rear container wall and a rear lid wall. In the present embodiment, the opposing first faces 11, 12 form minor walls 11, 12 which make up the side walls of the package 2. The first faces or side walls 11, 12 of the package 2 may comprise container side walls and lid side walls. The ends of the package 2 are closed by opposing end faces 13, 14. In the present embodiment, the first end face 13 may comprise a lid top wall and the second end face 14 may comprise a container bottom wall.

Referring now back to FIG. 1, it can be seen that the plurality of individual packages 2 for delivery systems which make up the collation 1 of packages 2 are arranged into rows. In the embodiment shown in FIG. 1, the collation 1 of packages 2 comprises a first row 16 and a second row 17. The first and second rows 16, 17 are adjacent one another.

The packages are arranged into rows 16, 17 in which each individual package 2 is aligned in a face-to-face orientation. In the present embodiment, the packages 2 are arranged into rows 16, 17 in face-to-face orientation such that a first face 11, 12 of a package 2 faces a first face 11, 12 of an adjacent package 2 within a row 16, 17. Furthermore, the packages 2 are arranged into rows 16, 17 in face-to-face orientation such that a second face 8, 9 of a package 2 in a row 16 faces a second face of a package 2 in an adjacent row 17. In addition, the packages 2 are arranged into rows 16, 17 in a face-to-face orientation such that a first face 11, 12 of a package 2 at an end 18, 19 of each row 16, 17 is exposed.

However, it will be appreciated that in alternative embodiments, the packages 2 may be arranged into rows 16, 17 in face-to-face orientation such that a second face 8, 9 of a package 2 faces a second face 8, 9 of an adjacent package 2 within a single row 16, 17 or by the face-to-face orientation of the end panels 13, 14 of adjacent packages 2 within a single row 16, 17.

In the present embodiment, the collation 1 comprises two rows of five packages 2. However, it will be understood that in an alternative embodiment, the number of packages in a row may be different and the number of rows present may be greater.

Each row 16, 17 has two ends 18, 19, as mentioned above. Each end 18, 19 of the rows 16, 17 comprise a free surface 21, 22. The free surface 21, 22 is formed by a first face 11, 12 of an individual package 2 which is located at the end 18, 19 of a row 16, 17. Therefore, the free surface 21, 22 formed by a first face 11, 12 of the package 2 at the end 18, 19 of the row 16, 17 does not face towards an adjacent package in the same row 16, 17. For example, in the present embodiment, the first row 16 of packages has an end 18 formed by the free surface 21 which is a first face 11 of the individual package 2 at the end 18 of the first row 16, and the second row 17 of packages has an end 19 formed by the free surface 22 which is a first face 12 of the individual package 2 at the end 19 of the second row 17.

Adjacent rows 16, 17 of the collations 1 of packages 2 are separated by a dividing line 23. The dividing line 23 is the boundary between two adjacent rows 16, 17, i.e. the boundary between a second face 8, 9 of a package 2 in a first row 16 and a second face 8, 9 of a package 2 in a second row 17 in the present embodiment. The adjacent rows 16, 17 may be located proximate to one another along the dividing line 23 and separated by a gap (not shown) or, more preferably, the adjacent rows 16, 17 may abut along the dividing line 23.

Figure 3:
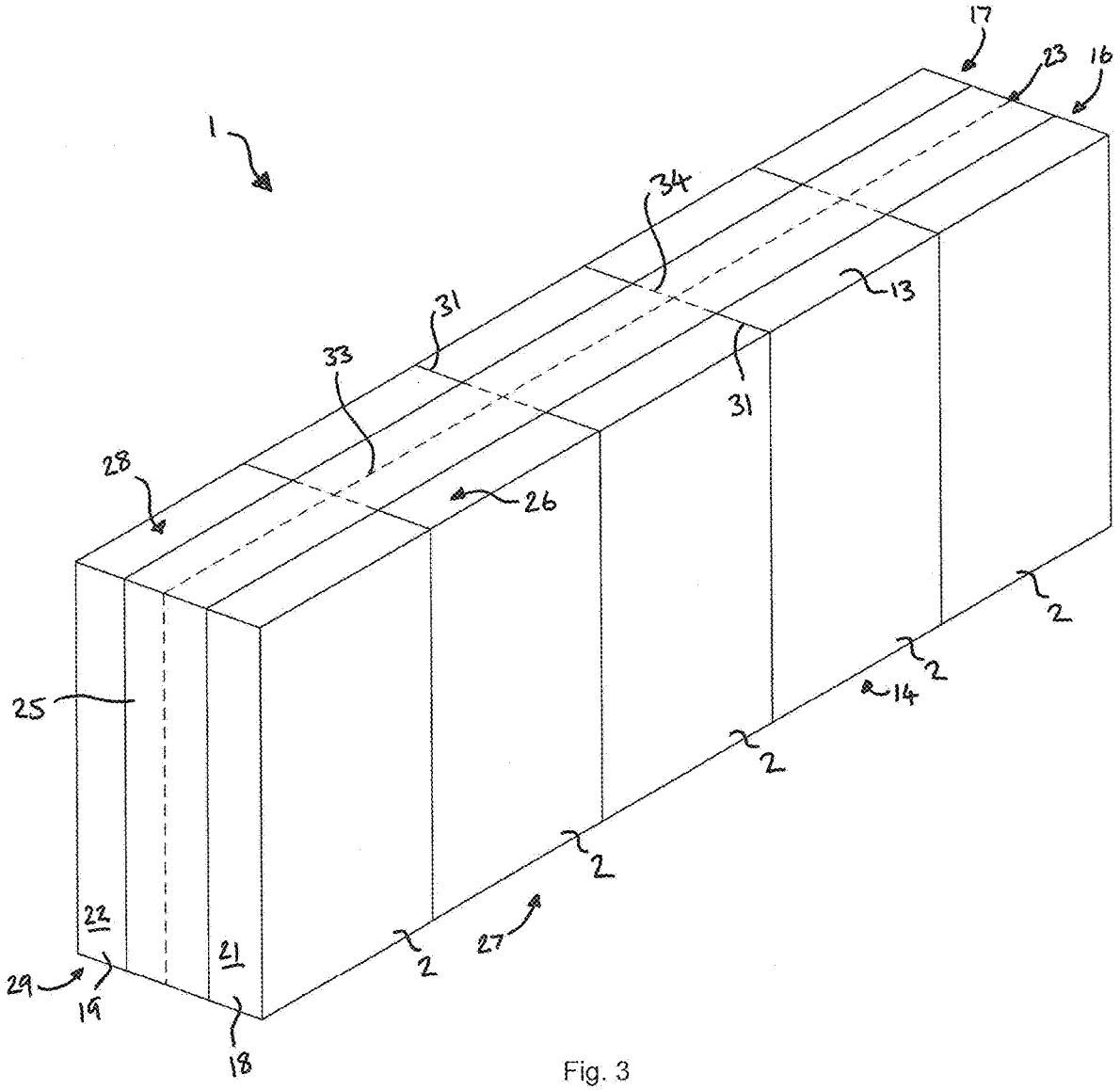
FIG. 3 shows a first embodiment of a collation of packages for delivery systems.

Referring now to FIG. 3, the collation 1 of packages 2 further comprises tape 25. The tape 25 is adhered to packages 2 across their end faces 13, 14 and is positioned so as to couple packages 2 in adjacent rows 16, 17 together. The tape 25 is also adhered to said exposed first faces 21, 22 of the packages 2 at the end 18, 19 of each row 16, 17 so as to extend across the exposed first faces 21, 22 of packages 2 in adjacent rows 16, 17.

That is, the tape 25 is configured such that the tape 25 extends across the dividing line 23 that separates the adjacent rows of packages 16, 17. For example, the tape 25 is attached to a package 2 in the first row of packages 16 and an adjacent package 2 on the opposite side of the dividing line 23 in the second row of packages 17. The tape 25 is configured to hold at least one package 2 in the first row of packages 16 to at least one package 2 in the second row of packages 17.

Preferably, the tape 25 is located on at least the free surfaces 21, 22 of the packages 2 at least one end 18, 19 of adjacent rows of packages 16, 17. For example, as shown in FIG. 3, it can be seen that tape 25 is located on the free surface 21 which forms one end 18 of the first row 16 and extends over the dividing line 23 such that the tape 25 is also located on the free surface 22 which forms one end 19 of the second row 17.

Each individual package 2 of the collation 1 comprises end faces surface 13, 14 which extend in the same plane. In the present embodiment, it is the top lid wall formed by the end face 13 of each package 2 that extends in the same plane. Furthermore, the bottom container wall formed by the end face 14 of each package 2 also extends in the same plane. The top lid walls 13 extend in a plane parallel and spaced from the bottom container walls.

The end faces 13, 14 of each package 2 in a row 16, 17 that extend in the same plane form side faces 26, 27, 28, 29 of the rows 16, 17. That is, the end faces 13 of the packages 2 in the first row 16 form a side face 26 of the first row 16; the end faces 14 of the packages 2 in the first row 16 form a side face 27 of the first row 16; the end faces 13 of the packages 2 in the second row 17 form a side face 28 of the second row 17, and the end faces 14 of the packages 2 in the second row 17 form a side face 29 of the second row 17.

Preferably, at least one of the side faces 26, 27 of the first row 16 and at least one of the side faces 28, 29 of the second row 17 extend in the same plane. More preferably, the side face 26 of the first row 16 and the side face 28 of the second row 17 extend in the same plane and the side face 27 of the first row 16 and the side face 29 of the second row 17 extend in the same plane. Therefore, the side faces 26, 27 of the first and second rows 16, 17 are adjacent to each other and in the same plane. Furthermore, the side faces 28, 29 of the first and second rows 16, 17 are adjacent to each other and in the same plane.

In the present invention tape 25 is located on adjacent side faces 26, 27, 28, 29 of the first and second rows 16, 17. That is, the tape 25 is located on at least a side face 26 of the first row 16 and extends over the dividing line 23 such that the tape is also located on at least a side face 28 of the second row 17. Therefore, the tape 25 extends over the dividing line 23 formed between end faces 13, 14 of packages 2 in a first row 16 and end faces 13, 14 of packages in a second row 17.

Preferably, the tape 25 is located on each surface 13, 14 which forms a part of a side surface 26, 27, 28, 29 of adjacent first and second rows 16, 17. For example, referring to FIG. 3, tape 25 is located on each surface of each package 2 formed by a top lid wall panel 13 in the first row 16 and in the adjacent second row 17.

More preferably, tape 25 is located on each free surface 21, 22 at the ends 18, 19 of adjacent first and second rows 16, 17 and on each end face 13, 14 which forms part of the side faces 26, 27, 28, 29 of adjacent first and second rows 16, 17. Therefore, tape 25 is located on the free surface 21 at the end 18 of the first row 16 and extends over the dividing line 23 to the free surface 22 at the end 19 of the second row 17 and tape 25 is located on a side surface 26, 27 of the first row 16 formed by end faces 13, 14 and extends over the dividing line 23 to a side surface 28, 29 of the second row 17 formed by end faces 13, 14.

In some embodiments, tape 25 is located on both ends 18, 19 of the adjacent first and second rows 16, 17 and on all the side surfaces 26, 27, 28, 29 of the adjacent first and second rows 16, 17 which are formed by end faces 13, 14 of the individual packages 2.

In some embodiments, such as the embodiment shown in FIG. 3, the tape 25 is formed by a single continuous tape 25. The single continuous tape may extend completely around the dividing line 23 formed between the adjacent free surfaces 21, 22 formed by first faces 11, 12 and the adjacent side faces 26, 27, 28, 29 formed by end faces 13, 140*f* the first and second rows 16, 17.

Figure 4:
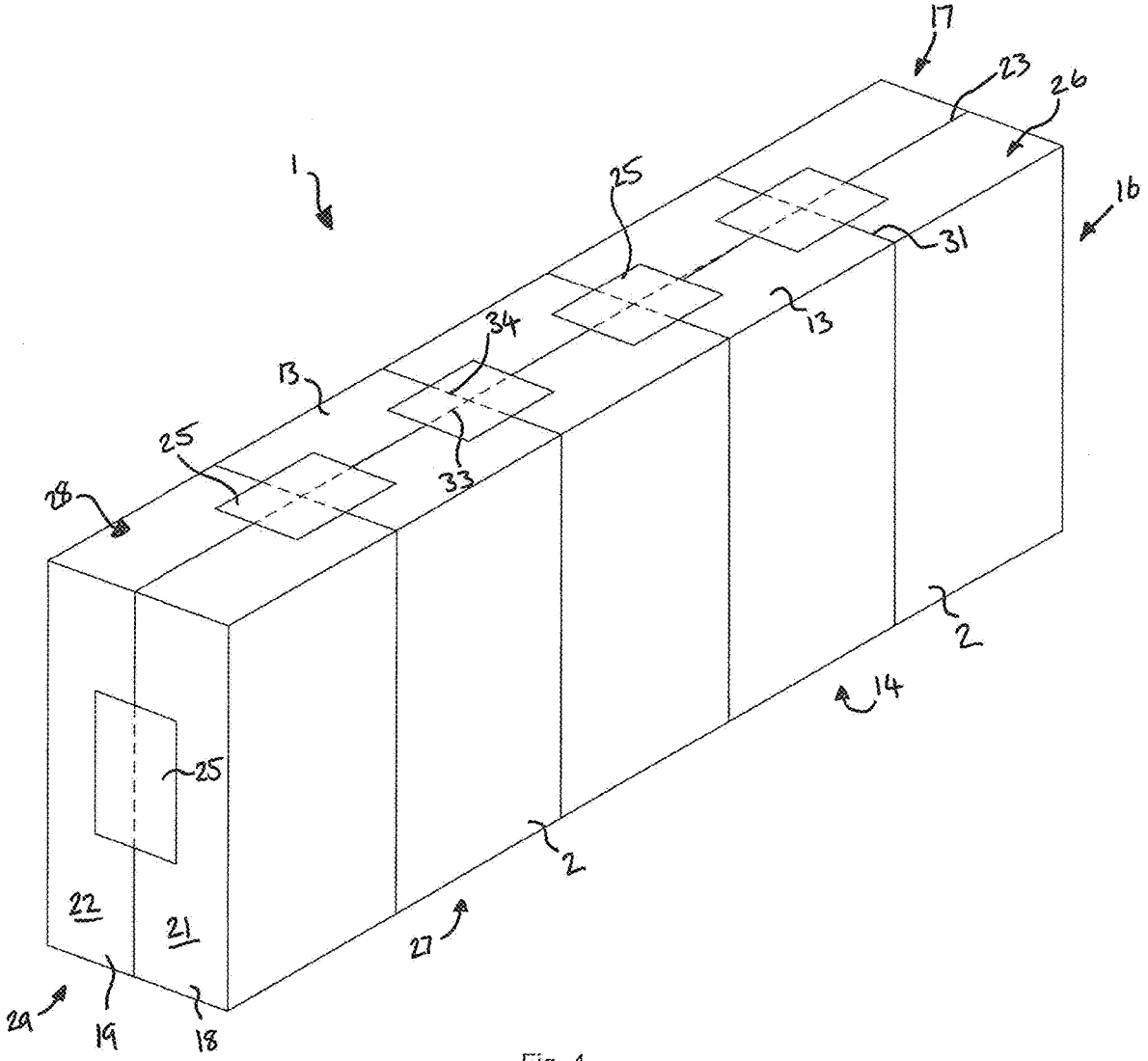
FIG. 4 shows a second embodiment of a collation of packages for delivery systems.

Referring to FIG. 4, there is shown a second embodiment of the collation 1 of packages 2. Instead of using a single continuous tape as done in the first embodiment, in the second embodiment the tape 25 may comprise a plurality of discrete portions of tape 25.

The longitudinal axis of at least one of the discrete portions of tape 25 extends parallel to the dividing line 23 between the adjacent first and second rows 16, 17. Furthermore, as in the first embodiment, the adjacent packages 2 within a row 16, 17 are separated by a separation line 31. The separation line 31 is the boundary between two adjacent packages 2 in face-to-face orientation within a row 16, 17, i.e. the boundary between a first face 11, 12 of a package 2 in a row 16, 17 and a first face 11, 12 of a package 2 in the same row in the present embodiment. The separation line 31 extends perpendicularly to the dividing line 23 which extends between adjacent rows 16, 17.

Referring to FIGS. 3 and 4, at least one tape 25 located on adjacent side faces 26, 27, 28, 29 of the first and second rows 16, 17 also overlaps at least one of the separation lines 31 in each row. Therefore, at least one tape 25 is located on four different individual packages 2 and configured to hold the four adjacent packages 2 together.

The tape 25 may be an adhesive tape. The adhesive tape 25 may be, for example, but not limited to, a paper label, preferably with a weight between 60 and 90 gsm, or film labels, preferably with thickness of between 20 and 70 microns. The films labels may be formed by PP, PE, PVC, and or Polyester.

The tape 25 may have an adhesive such as, for example, but not limited to, a pressure sensitive adhesive. Pressure sensitive adhesives are a type of non-reactive adhesive which forms a bond when pressure is applied to bond the adhesive with the adherend, instead of requiring a solvent, water, or heat to activate the adhesive. In some embodiments, the pressure sensitive adhesive may be based on an elastomer compounded with a tackifier, for example, a rosin ester. The elastomers may be based on acrylics which do not require a tackifier, or bio-based acrylate.

Furthermore, the at least one tape 25 may comprise a line of weakening 33, 34. The line of weakening is configured to allow an individual package 2 to be separated from its adjacent packages without the remaining packages 2 of the collation 1 being separated. The line of weakening 33, 34 may be a continuous line of weakening 33, 34 which extends fully across the at least one tape 25.

As shown in the illustrated embodiments, a first line of weakening 33 is formed by a longitudinal line of weakening which extends parallel to the dividing line 23 between adjacent rows 16, 17. The longitudinal line of weakening 33 is configured to allow a package 2 in the first row 16 to be separated from the opposite package 2 in the adjacent second row 17. Preferably, the longitudinal line of weakening 33 extends coincidentally with the dividing line 23 between adjacent rows 16, 17. Therefore, it is easier to separate a package 2 in the first row 16 from a package 2 in the second row 17.

Furthermore, a second line of weakening 34 is formed by a transverse line of weakening which extends parallel to the separation line 31 between adjacent packages 2 within a row 16, 17. The transverse line of weakening 34 is configured to allow packages 2 within the same row 16, 17 to be separated from each other. Preferably, the transverse line of weakening 34 extends coincidentally with the separation line 31 between adjacent packages in the same row 16, 17. Therefore, it is easier to separate a package 2 from its adjacent package 2 in the same row.

Lines of weakening may be formed by perforations on the tape 25 which may be applied on line on the packing machine or pre perforated and supplied on a reel of tape 25.

Where a line of weakening 33, 34 is provided on a pre perforated reel of tape 25, each piece of the tape 25 may be provided with a registration mark to aid in placing the line of weakening 33, 34 coincidentally with a dividing line 23 between adjacent rows 16, 17 and/or with a separation line 31 between adjacent packages 2 in the same row 16, 17.

The registration mark may be, for example, but not limited to, a printed marking such as a bar in a contrasting colour to the remainder of the tape 25 or the packages 2 below when the adhesive tape is transparent, or a UV indicator or marking which is visible to a registration system (not shown) configured to apply the tape 25 to a collation 1 of packages. In some examples, a registration mark may take the form of the dashed lines shown on the tape 25 in FIGS. 3 and 4 which schematically represent the lines of weakening 33, 34.

Therefore, the registration mark comprises at least one marking which is coincident with at least one of the lines of weakening 33, 34 on the tape 25. For example, the registration mark may comprise at least one marking which is coincident with the first line of weakening 33 and/or the second line of weakening 34.

By connecting the adjacent packages 2 with an adhesive tape 25, the material used to hold together packages 2 is reduced. This reduces waste products and minimises production time. Furthermore, a consumer may separate the packages 2 from one another when they choose instead of each package becoming separated when removed from a carton or wrap. Furthermore, a consumer may separate a plurality of packages 2 from the collation 1 to take with them without the packages of plurality of packages 2 removed from the collation 1 or the packages of the remainder of the collation separating from each other.

The various embodiments described herein are presented only to assist in understanding and teaching the claimed features. These embodiments are provided as a representative sample of embodiments only, and are not exhaustive and/or exclusive. It is also to be understood that advantages, embodiments, examples, functions, features, structures, and/or other aspects described herein are not to be considered limitations on the scope of the invention as defined by the claims or limitations on equivalents to the claims, and that other embodiments may be utilised and modifications may be made without departing from the scope of the claimed invention. Various embodiments of the invention may suitably comprise, consist of, or consist essentially of, appropriate combinations of the disclosed elements, components, features, parts, steps, means, etc, other than those specifically described herein. In addition, this disclosure may include other inventions not presently claimed, but which may be claimed in future.

The invention claimed is:

1. A collation of packages, the collation comprising:

a plurality of individual packages, each package comprising a pair of opposing first faces, a pair of opposing second faces and a pair of opposing end faces, wherein the packages are arranged in rows in which each package is aligned in a face-to face orientation such that a first face of a package faces a first face of an adjacent package within a row, and a second face of a package in a row faces a second face of a package in an adjacent row, and a first face of a package at the end of each row is exposed; and wherein tape is adhered to the packages across their end faces and is positioned so as to couple packages in adjacent rows together, and packages within the same row together, wherein tape is also adhered to said exposed first faces of the packages at the end of each row so as to extend across the exposed first faces of adjacent packages, wherein the tape comprises a plurality of discrete portions of tape, and wherein a longitudinal axis of a discrete portion of tape extends parallel to a dividing line between the second faces of packages in a first row and the second faces of packages in a second row.

2. The collation of packages according to claim 1, wherein adjacent packages in a row are separated by a separation line formed between adjacent first faces in a row, wherein at least one adhesive tape located on adjacent side faces of the first and second rows of packages overlaps the separation line.

3. The collation of packages according to claim 2, wherein the separation line extends perpendicularly to the dividing line between adjacent rows.

4. The collation of packages according to claim 1, wherein the tape comprises a line of weakening configured to allow an individual package to be separated from its adjacent packages without the remaining packages of the collation being separated.

5. The collation of packages according to claim 4, wherein the line of weakening is a continuous line of weakening.

6. The collation of packages according to claim 4, wherein the line of weakening is a longitudinal line of weakening which extends parallel to the dividing line between adjacent rows of packages.

7. The collation of packages according to claim 6, wherein the longitudinal line of weakening extends coincidentally with the dividing line between adjacent rows of packages.

8. The collation of packages according to claim 4, wherein the tape comprises a line of weakening which is a transverse line of weakening which extends parallel to a separation line between adjacent packages in a row.

9. The collation of packages according to claim 8, wherein the transverse line of weakening extends coincidentally with the separation line between individual packages in a row.

10. The collation of packages according to claim 6, wherein the tape comprises a registration mark configured to aid in placing the line of weakening of the tape coincidentally with the dividing line and/or separation line.

11. The collation of packages according to claim 10, wherein the registration mark comprises a marking which is coincident with the line of weakening.

* * * * *